US010460887B2

(12) United States Patent
Krause

(10) Patent No.: US 10,460,887 B2
(45) Date of Patent: Oct. 29, 2019

(54) SYSTEM AND METHOD FOR PROVIDING FUNCTIONAL SAFETY MONITORING OF RELAY CONTACTS

(71) Applicant: Siemens Aktiengesellschaft, München (DE)

(72) Inventor: Peter Krause, Johnson City, TN (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 0 days.

(21) Appl. No.: 16/084,981

(22) PCT Filed: May 18, 2016

(86) PCT No.: PCT/US2016/033058

§ 371 (c)(1),
(2) Date: Sep. 14, 2018

(87) PCT Pub. No.: WO2017/200539

PCT Pub. Date: Nov. 23, 2017

(65) Prior Publication Data

US 2019/0080858 A1 Mar. 14, 2019

(51) Int. Cl.
*H01H 9/16* (2006.01)
*H01H 1/00* (2006.01)
(Continued)

(52) U.S. Cl.
CPC ..... *H01H 9/167* (2013.01); *G08B 21/187* (2013.01); *H01H 1/0015* (2013.01);
(Continued)

(58) Field of Classification Search
CPC combination set(s) only.
See application file for complete search history.

(56) References Cited

U.S. PATENT DOCUMENTS 5,614,888 A * 3/1997 Borchmann ..... H02H 3/04 335/17
6,121,886 A * 9/2000 Andersen ..... G05B 23/0235 340/635
(Continued)

FOREIGN PATENT DOCUMENTS

EP 2879152 A1 6/2015

OTHER PUBLICATIONS

PCT International Search Report and Written Opinion of International Searching Authority dated Dec. 14, 2016 rresponding to PCT International Application No. PCT/US2016/033058 filed May 18, 2016.

*Primary Examiner* — Travis R Hunnings

(57) ABSTRACT

A system (100) and method is provided that facilitates functional safety monitoring of relay contacts. The system may include a contactless sensor circuit (108) that includes: an output signal antenna (110) positioned in the contactless sensor circuit to extend between at least two contacts (116, 118) of a relay (120); and first and second input signal antennas (112, 114) positioned in the contactless sensor circuit respectively adjacent the at least two contacts of the relay, such that the output signal antenna and the at least two contacts of the relay are positioned between the first and second input signal antennas. The system may also include a processor (102) configured to cause the output signal antenna to output a wireless signal (122) capable of being received by the first and second input signal antennas while the processor monitors wireless signals received by the first and second input signals antennas. The processor may be configured to determine that the relay has a fault based on the wireless signals received by the first and second input
(Continued)

signal antennas, and responsive thereto output at least one communication (126) indicative of a fault with the relay being detected.

15 Claims, 3 Drawing Sheets

(51) Int. Cl.
*H01H 47/00* (2006.01)
*G08B 21/18* (2006.01)
*H01H 3/00* (2006.01)

(52) U.S. Cl.
CPC ..... *H01H 9/168* (2013.01); *H01H 47/002* (2013.01); *H01H 3/001* (2013.01)

(56) References Cited

U.S. PATENT DOCUMENTS 6,525,542 B2 * 2/2003 Price ..... H02H 1/0038
324/509
2001/0026159 A1 * 10/2001 Price ..... H02H 1/0038
324/509

* cited by examiner

SYSTEM AND METHOD FOR PROVIDING FUNCTIONAL SAFETY MONITORING OF RELAY CONTACTS

CROSS REFERENCE TO RELATED APPLICATIONS

This Application is the U.S. National Stage of International Application No. PCT/US2016/033058 filed 18 May 2016 and claims benefit thereof, the entire content of which is hereby incorporated herein by reference.

TECHNICAL FIELD

The present disclosure is directed, in general, to functional safety applications that use relays to selectively control power through an electronic circuit.

BACKGROUND

Functional safety features of systems are implemented to minimize risk of physical injury to people or damage to property. Functional safety standards, for example, are present in industries involving automobiles, railways, aviation, nuclear power plants, and manufacturing. Devices used to achieve functional safety in systems may benefit from improvements.

SUMMARY

Variously disclosed embodiments include systems and methods used to facilitate functional safety monitoring of relay contacts. In one example, the system may comprise a contactless sensor circuit that includes: an output signal antenna positioned in the contactless sensor circuit to extend between at least two contacts of a relay; and first and second input signal antennas positioned in the contactless sensor circuit respectively adjacent the at least two contacts of the relay, such that the output signal antenna and the at least two contacts of the relay are positioned between the first and second input signal antennas. The system may also include a processor configured to cause the output signal antenna to output a wireless signal capable of being received by the first and second input signal antennas while the processor monitors wireless signals received by the first and second input signals antennas. The processor may be configured to determine that the relay has a fault based on the wireless signals received by the first and second input signal antennas, and responsive thereto output at least one communication indicative of a fault with the relay being detected.

In another example, a method for providing functional safety monitoring of relay contacts may comprise acts carried out through operation of a processor in electrical communication with a contactless sensor circuit. The contactless sensor circuit may include: an output signal antenna positioned in the contactless sensor circuit to extend between at least two contacts of a relay; and first and second input signal antennas positioned in the contactless sensor circuit respectively adjacent the at least two contacts of the relay, such that the output signal antenna and the at least two contacts of the relay are positioned between the first and second input signal antennas. The acts may include: causing the output signal antenna to output a wireless signal capable of being received by the first and second input signal antennas; monitoring wireless signals received by the first and second input signal antennas; determining that the relay has a fault based on the wireless signals received by the first and second input signal antennas; and responsive to determining that the relay has the fault, outputting at least one communication indicative of a fault with the relay being detected.

A further example may include a non-transitory computer readable medium encoded with executable instructions (such as a firmware component on a storage device) that when executed, causes at least one processor to carry out this described method.

The foregoing has outlined rather broadly the technical features of the present disclosure so that those skilled in the art may better understand the detailed description that follows. Additional features and advantages of the disclosure will be described hereinafter that form the subject of the claims. Those skilled in the art will appreciate that they may readily use the conception and the specific embodiments disclosed as a basis for modifying or designing other structures for carrying out the same purposes of the present disclosure. Those skilled in the art will also realize that such equivalent constructions do not depart from the spirit and scope of the disclosure in its broadest form.

Also, before undertaking the Detailed Description below, it should be understood that various definitions for certain words and phrases are provided throughout this patent document, and those of ordinary skill in the art will understand that such definitions apply in many, if not most, instances to prior as well as future uses of such defined words and phrases. While some terms may include a wide variety of embodiments, the appended claims may expressly limit these terms to specific embodiments.

DETAILED DESCRIPTION

Figure 1:
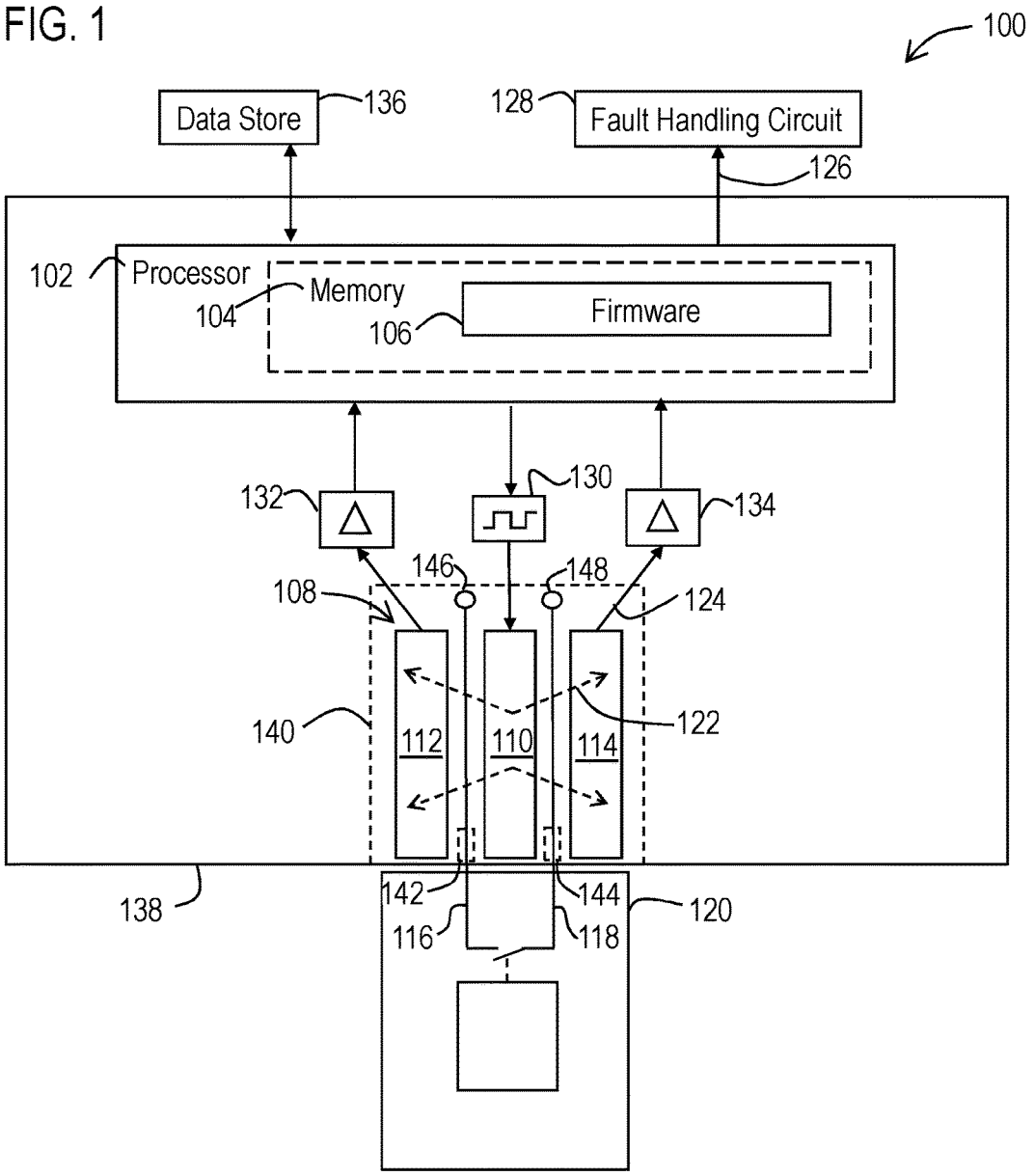
FIG. 1 illustrates a functional block diagram of an example system that facilitates functional safety monitoring of relay contacts.

Various technologies that pertain to systems and methods that facilitate functional safety monitoring of relay contacts will now be described with reference to the drawings, where like reference numerals represent like elements throughout. The drawings discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged apparatus. It is to be understood that functionality that is described as being carried out by certain system elements may be performed by multiple elements. Similarly, for instance, an element may be configured to perform functionality that is described as being carried out by multiple elements. The numerous innovative teachings of the present application will be described with reference to exemplary non-limiting embodiments.

Use used herein, a relay corresponds to an electrical device that functions as an electronically controlled switch. A relay, for example, is configured to open or close an output circuit responsive to a signal or current received in a relatively lower power (control) circuit. Some relays may use an electromagnet to cause an armature to pivot between a position that opens the output circuit to another position that closes the output circuit. Other relays may correspond to a solid state electronic component (without moving components) that uses a thyrister or TRIAC, for example, to open or close the output circuit. In addition, contactors used with electric motors, for example, correspond to heavy-duty relays.

The output circuit of relays typically includes metal projections called contacts that extend outwardly of the relay enclosure and function as terminals usable to connect the relay to portions of another circuit. For example, such contacts may be mounted to a power source and a desired load (e.g., a motor or light) for a particular application. In some applications the contacts may plug into a socket configured to receive the particular arrangement of contacts that a relay may have. In other applications, the contacts may be soldered to electrical connections on a printed circuit board (PCB) for example. It should also be appreciated that different relays may have different numbers of contacts.

It should be appreciated that relays may wear out over time. For example, an electromagnet based relay with metal contacts may weld shut after excessive use. If the weld prevents the output circuit from opening, the relay could cause a hazardous outcome, in which a device (such as a motor) cannot be shut down via the control circuit of the relay.

Example embodiments are directed to monitoring relays via contactless sensors mounted adjacent the contacts of the relay in order to facilitate functional safety monitoring of relay contacts. Such contactless sensors may be provided in a manner that is configured to detect a fault associated with the contacts of the relay (such as welded contacts) without interfering with the electrical characteristics of the relay.

With reference to FIG. 1, an example system 100 is illustrated that facilitates functional safety monitoring of relay contacts. The system 100 may include at least one processor 102. As used herein, a processor corresponds to any electronic device that is configured via hardware circuits, software, and/or firmware to process data. For example, processors described herein may correspond to one or more (or a combination) of a microprocessor, CPU, FPGA, ASIC, or any other integrated circuit (IC) or other type of circuit that is capable of processing data and carrying out the various functions described herein. A processor in the form of a microprocessor, for example, may include a memory 104 and may be configured to execute at least one application component 106 (such as a firmware) from the memory 104. The application component may be configured (i.e., programmed) to cause the processor to carry out various acts and functions described herein.

In an example embodiment, the processor may be in operative connection with a contactless sensor circuit 108. The contactless sensor circuit may include an output signal antenna 110 positioned in the contactless sensor circuit to extend between at least two contacts 116, 118 of a relay 120. The contactless sensor may also include first and second input signal antennas 112, 114 positioned in the contactless sensor circuit respectively adjacent the at least two contacts of the relay, such that the output signal antenna and the at least two contacts of the relay are positioned between the first and second input signal antennas.

In this example the described antennas 110, 112, 114 may correspond to conductive metal strips or wires positioned parallel to and within 0.1 to 2.0 mm of an adjacent contact. However, it should be appreciated that alternative embodiments of the antennas may have other configurations and distances from adjacent contacts in order facilitate the functionality described herein.

In this described example, the processor 102 may be configured to cause the output signal antenna to output a wireless signal 122 capable of being received by the first and second input signal antennas while the processor monitors detected signals 124 received by the first and second input signals antennas, wherein the at least one processor is configured to determine that the relay has a fault based on the detected signals received by the first and second input signals, and responsive thereto output at least one communication 126 indicative of a fault with the relay being detected.

In an example embodiment, the communication 126 indicative of a fault may be communicated to a fault handling circuit 128. Such a fault handling circuit may be configured to take an action that minimizes hazards associated with the detected faulty relay. Such actions may include operating a second relay to remove electrical power in a circuit controlled via the faulty relay. In another example, such actions may include reporting the fault to an entity that has responsibility for the safety and repair of the system that includes the relay. Such reporting may be carried out by: storing data associated with the fault to a data store; issuing an alarm signal (visual light and/or audible sound); and/or sending text, voice, e-mail messages or other network communication to one or more communication devices (PCs, mobile phones, workstations, servers).

As shown in FIG. 1, the contactless sensor circuit 108 may include a signal generator that is controlled by the processor and that provides a signal that drives the output signal antenna 110 to produce the wireless signal 122. Such a signal generator may correspond to a device (such as an integrated circuit) that is capable of outputting a waveform (e.g., triangle, saw tooth, sine, square, pulse) with an amplitude and frequency specified by the processor 102, that produces a corresponding waveform in the wireless signal 122.

In addition, the contactless sensor circuit 108 may include a processing circuit 132,134 in operative connection with each respective input signal antenna 112, 114. Such a processing circuit may amplify, filter, and/or carry out other processes on the detected signals 124 in order to provide the processor 102 with information that may be indicative of a correctly functioning relay and a faulty relay. The processor may then be configured to generate the at least one communication based on the information being indicative of a faulty relay.

In example embodiments, electrical characteristics of the contacts 116, 118 are operative to affect the wireless signals 122 that are respectively detected by each of the input signal antennas. For example, inductive loading caused by a current through the contacts 116, 118 may affect the detection of the wireless signals 122 by the of the input signal antennas. Further, electrical continuity changes in the relay between an open and closed position of the relay may affect the detection of the wireless signals 122 by the input signal antennas. Such detected changes may be monitored by the processor 102 to determine whether the relay is or is not faulty. As used herein detected information from the detection of wireless signals corresponds to measurements of the relay.

In addition, it should be appreciated that the input signal antennas may be operative to detect other signals from the relay that correspond to measurements of the relay. For example, the input signals antennas may be configured to detect radio frequency signals emitted from the contacts, as well as changes in capacitance caused by electrical power connected to one or more of the contacts and/or currently flowing therethrough.

In example embodiments, the processing circuits 132, 134 may further include analog-to-digital converters (DACs). Such DACs may be configured to provide the processor 102 with digital information corresponding to the measurements of the relay.

In some example embodiments, the processor may be operative to compare one or more of the measurements of the relay to one or more predetermined thresholds to determine if the detected measurements are indicative of a fault in the relay. In addition, to account for variability in electrical characteristics between different relays, the described processor may be configured to capture a baseline measurement or set of measurements for a relay and store such baseline data in the memory 104 or other data store 136. Over time, further measurements of the relay may be compared to the stored baseline data to determine if changes in measurements overtime have breached one or more predetermined thresholds indicative of a faulty relay.

As illustrated in FIG. 1, in example embodiments, the contactless sensor circuit 108 is arranged such that the contacts 116, 118 extend directly between the output signal antenna 110 and input signal antennas 112, 114. In order to provide such an arrangement, such antennas 110, 112, 114 may be mounted on a printed circuit board (PCB) 138, to which the relay 120 is mounted. For example, the relay 120 may have contacts 116, 118 that are soldered to the board, and the antennas 110, 112, 114 may be formed as conductive stripes or wires that are formed on the board.

In another embodiment, a socket 140 may be mounted to the board and the relay 120 may be in removable connection with the socket. For example, as schematically illustrated in FIG. 1, the relay socket may include a plurality of openings/receptacles 142, 144 for receiving the terminals 146, 148 of the relay (i.e., which terminals include the relay contacts 116, 118). Such openings/receptacles may be positioned to align the contacts between the antennas 110, 112, 114 on the board 138.

However, in other embodiments, the contactless sensor circuit 108 may be mounted within the relay socket 140. For example, the described output sensor antenna 110 and input signal sensors 112, 114 may be mounted adjacent and parallel to the receptacles 142,144 on the relay socket.

It should be noted that some relays may have more than two contacts (or terminals connected to contacts) that extend out of the relay body. Thus, in some embodiments, the system may include more than one of the described contactless sensor circuit arranged between different pairs of contacts.

It should also be understood that the described embodiments enable the use of regular relays (i.e., non-safety relays) in functional safely applications via the addition of the described processor 102 and contactless sensor circuit 108 in connection with the relay socket and/or PCB board to which the relay is mounted. Further, the described contactless system enables faults to be detected in non-safety relays without directly wiring sensors to the contacts of the relay.

Figure 2:
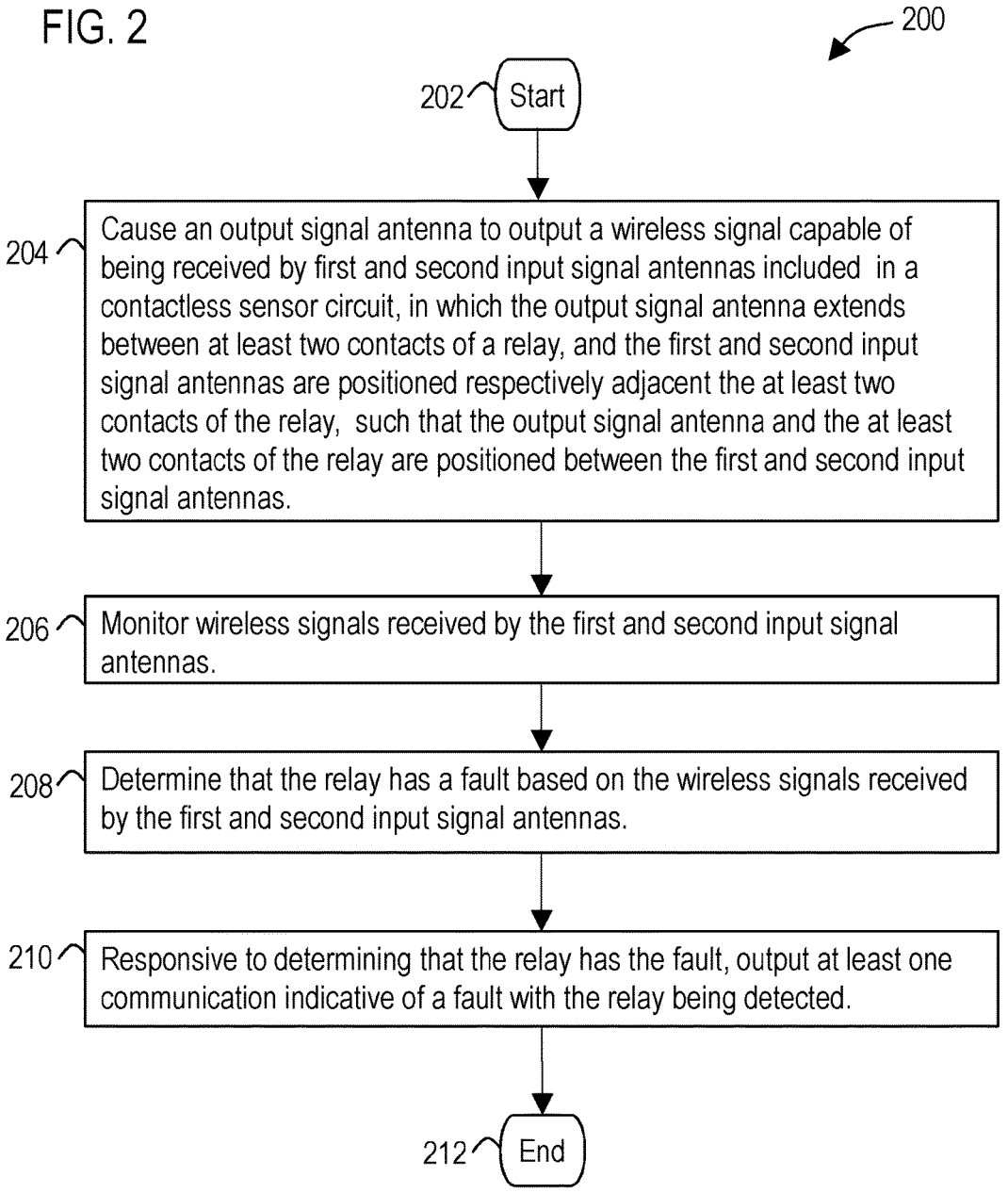
FIG. 2 illustrates a flow diagram of an example methodology that facilitates functional safety monitoring of relay contacts.

With reference now to FIG. 2, various example methodologies are illustrated and described. While the methodologies are described as being a series of acts that are performed in a sequence, it is to be understood that the methodologies may not be limited by the order of the sequence. For instance, some acts may occur in a different order than what is described herein. In addition, an act may occur concurrently with another act. Furthermore, in some instances, not all acts may be required to implement a methodology described herein.

It is important to note that while the disclosure includes a description in the context of a fully functional system and/or a series of acts, those skilled in the art will appreciate that at least portions of the mechanism of the present disclosure and/or described acts are capable of being distributed in the form of computer-executable instructions contained within non-transitory machine-usable, computer-usable, or computer-readable medium in any of a variety of forms, and that the present disclosure applies equally regardless of the particular type of instruction or data bearing medium or storage medium utilized to actually carry out the distribution. Examples of non-transitory machine usable/readable or computer usable/readable mediums include: ROMs, EPROMs, magnetic tape, floppy disks, hard disk drives, SSDs, flash memory, CDs, DVDs, and Blu-ray disks. The computer-executable instructions may include a routine, a sub-routine, programs, applications, modules, libraries, and/or the like. Still further, results of acts of the methodologies may be stored in a computer-readable medium, displayed on a display device, and/or the like.

Referring now to FIG. 2, a methodology 200 is illustrated that facilitates functional safety monitoring of relay contacts. The method may start at 202 and the methodology may include several acts carried out through operation of at least one processor.

These acts may include an act 204 of causing an output signal antenna to output a wireless signal capable of being received by first and second input signal antennas included in a contactless sensor circuit. For such a contactless sensor circuit, the output signal antenna may be positioned to extend between at least two contacts of a relay. Also the first and second input signal antennas may be positioned respectively adjacent the at least two contacts of the relay, such that the output signal antenna and the at least two contacts of the relay are positioned between the first and second input signal antennas. In addition, the methodology may include an act 206 of monitoring wireless signals received by the first and second input signal antennas. Further, the methodology may include an act 208 of determining that the relay has a fault based on the wireless signals received by the first and second input signal antennas. Also responsive to determining that the relay has the fault, the methodology may include an act 210 of outputting at least one communication indicative of a fault with the relay being detected. At 214 the methodology may end.

It should be appreciated that the methodology 200 may include other acts and features discussed previously with respect to the processing system 100. For example, during the act 206 of monitoring wireless signals, the relay may be mounted to a printed circuit board such that the output signal antenna is positioned between and parallel to the at least two contacts and the first and second input signal antennas are positioned parallel to and adjacent to the at least two contacts.

In addition, during the monitoring act 206, the relay may include at least two terminals that include the at least two contacts, which terminals are inserted into a relay socket. Also during the monitoring act 206, the output signal antenna and the first and second input signal antennas may be mounted to the relay socket. However, in other example embodiments, the output signal antenna and the first and second input signal antennas may be mounted to the printed circuit board.

In addition the methodology 200 may include an act through operation of the processor of causing the signal generator to cause the output signal antenna to output the wireless signal. In addition through operation of the at least two processing circuits described previously, the methodology may include at least one of amplifying or filtering the wireless signals detected by the first and second input signal antennas and providing information therefrom to the processor.

In this example, the at least one communication indicative of a fault with the relay being detected may be outputted to at least one fault handling circuit based on the information provided by the at least two processing circuits. The methodology may then further comprise through operation of the fault handling circuit: removing electrical power from the relay; outputting a visual and/or audible alarm signal; or a combination thereof. Also as described previously, the fault handling circuit may store information regarding the fault in a data store and/or may communicate the detection of the fault with the relay via a text message, e-mail, or other network communication.

As discussed previously, acts associated with these methodologies (other than any described manual acts) may be carried out by one or more processors. Such processor(s) may be included in one or more data processing systems such as a microcontroller that that executes firmware (such as the described application component 106) operative to cause these acts to be carried out by the one or more processors. However, in alternative embodiments the data processing system may include a processor configured to execute software components retrieved form a non-volatile data store. Such firmware or software may comprise computer-executable instructions corresponding to a routine, a sub-routine, programs, applications, modules, libraries, a thread of execution, and/or the like. Further, it should be appreciated that software components may be written in and/or produced by software environments/languages/frameworks such as C, C#, C++ or any other software tool capable of producing components configured to carry out the acts and features described herein.

Figure 3:
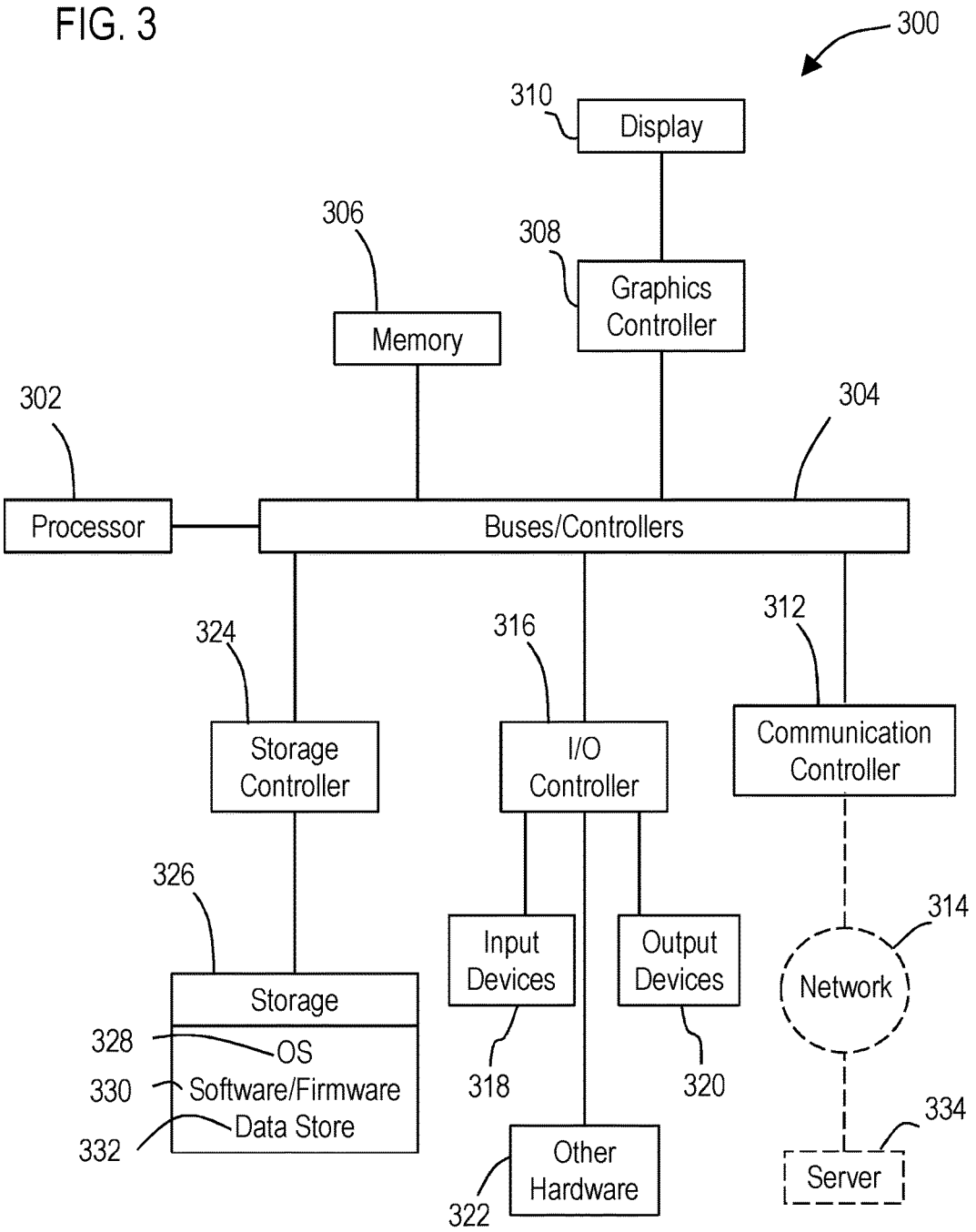
FIG. 3 illustrates a block diagram of a data processing system in which an embodiment may be implemented.

FIG. 3 illustrates a block diagram of a data processing system 300 in which an embodiment may be implemented. The data processing system depicted includes at least one processor 302 (e.g., a CPU) that may be connected to one or more bridges/controllers/buses 304 (e.g., a north bridge, a south bridge). One of the buses 304, for example, may include one or more I/O buses such as a PCI Express bus. Also connected to various buses in the depicted example may include a main memory 306 (RAM) and in some embodiments a graphics controller 308. The graphics controller 308 may be connected to one or more display devices 310. It should also be noted that in some embodiments one or more controllers (e.g., graphics, south bridge) may be integrated with the CPU (on the same chip or die). Examples of CPU architectures include IA-32, x86-64, and ARM processor architectures.

Other peripherals connected to one or more buses may include communication controllers 312 (Ethernet controllers, WiFi controllers, cellular controllers) operative to connect to a local area network (LAN), Wide Area Network (WAN), a cellular network, and/or other wired or wireless networks 314 or communication equipment.

Further components connected to various busses may include one or more I/O controllers 316 such as USB controllers, Bluetooth controllers, and/or dedicated audio controllers (connected to speakers and/or microphones). It should also be appreciated that various peripherals may be connected to the I/O controller(s) (via various ports and connections) including input devices 318 (e.g., keyboard, mouse, pointer, touch screen, touch pad, drawing tablet, trackball, buttons, keypad, game controller, gamepad, camera, microphone, scanners, motion sensing devices that capture motion gestures), output devices 320 (e.g., printers, speakers) or any other type of device that is operative to provide inputs to or receive outputs from the data processing system. Also, it should be appreciated that many devices referred to as input devices or output devices may both provide inputs and receive outputs of communications with the data processing system. For example, the processor 302 may be integrated into a housing (such as a tablet) that includes a touch screen that serves as both an input and display device. Further, it should be appreciated that some input devices (such as a laptop) may include a plurality of different types of input devices (e.g., touch screen, touch pad, and keyboard). Also, it should be appreciated that other peripheral hardware 322 connected to the I/O controllers 316 may include any type of device, machine, or component that is configured to communicate with a data processing system.

Additional components connected to various busses may include one or more storage controllers 324 (e.g., SATA). A storage controller may be connected to a storage device 326 such as one or more storage drives and/or any associated removable media, which can be any suitable non-transitory machine usable or machine readable storage medium. Examples, include nonvolatile devices, volatile devices, read only devices, writable devices, ROMs, EPROMs, magnetic tape storage, floppy disk drives, hard disk drives, solid-state drives (SSDs), flash memory, optical disk drives (CDs, DVDs, Blu-ray), and other known optical, electrical, or magnetic storage devices drives and/or computer media. Also in some examples, a storage device such as an SSD may be connected directly to an I/O bus 304 such as a PCI Express bus.

A data processing system in accordance with an embodiment of the present disclosure may include an operating system 328, software/firmware 330, and data stores 332 (that may be stored on a storage device 326 and/or the memory 306). Such an operating system may employ a command line interface (CLI) shell and/or a graphical user interface (GUI) shell. The GUI shell permits multiple display windows to be presented in the graphical user interface simultaneously, with each display window providing an interface to a different application or to a different instance of the same application. A cursor or pointer in the graphical user interface may be manipulated by a user through a pointing device such as a mouse or touch screen. The position of the cursor/pointer may be changed and/or an event, such as clicking a mouse button or touching a touch screen, may be generated to actuate a desired response. Examples of operating systems that may be used in a data processing system may include Microsoft Windows, Linux, UNIX, iOS, and Android operating systems. Also, examples of data stores include data files, data tables, relational database (e.g., Oracle, Microsoft SQL Server), database servers, or any other structure and/or device that is capable of storing data, which is retrievable by a processor.

The communication controllers 312 may be connected to the network 314 (not a part of data processing system 300), which can be any public or private data processing system network or combination of networks, as known to those of skill in the art, including the Internet. Data processing system 300 can communicate over the network 314 with one or more other data processing systems such as a server 334

(also not part of the data processing system 300). However, an alternative data processing system may correspond to a plurality of data processing systems implemented as part of a distributed system in which processors associated with several data processing systems may be in communication by way of one or more network connections and may collectively perform tasks described as being performed by a single data processing system. Thus, it is to be understood that when referring to a data processing system, such a system may be implemented across several data processing systems organized in a distributed system in communication with each other via a network.

Further, the term "controller" means any device, system or part thereof that controls at least one operation, whether such a device is implemented in hardware, firmware, software or some combination of at least two of the same. It should be noted that the functionality associated with any particular controller may be centralized or distributed, whether locally or remotely.

In addition, it should be appreciated that data processing systems may be implemented as virtual machines in a virtual machine architecture or cloud environment. For example, the processor 302 and associated components may correspond to a virtual machine executing in a virtual machine environment of one or more servers. Examples of virtual machine architectures include VMware ESCi, Microsoft Hyper-V, Xen, and KVM.

Those of ordinary skill in the art will appreciate that the hardware depicted for the data processing system may vary for particular implementations. For example, the data processing system 300 in this example may correspond to a controller, computer, workstation, server, PC, notebook computer, tablet, mobile phone, and/or any other type of apparatus/system that is operative to process data and carry out functionality and features described herein associated with the operation of a data processing system, computer, processor, and/or a controller discussed herein. The depicted example is provided for the purpose of explanation only and is not meant to imply architectural limitations with respect to the present disclosure.

Also, it should be noted that the processor described herein may be located in a server that is remote from the display and input devices described herein. In such an example, the described display device and input device may be included in a client device that communicates with the server (and/or a virtual machine executing on the server) through a wired or wireless network (which may include the Internet). In some embodiments, such a client device, for example, may execute a remote desktop application or may correspond to a portal device that carries out a remote desktop protocol with the server in order to send inputs from an input device to the server and receive visual information from the server to display through a display device. Examples of such remote desktop protocols include Teradici's PCoIP, Microsoft's RDP, and the RFB protocol. In such examples, the processor described herein may correspond to a virtual processor of a virtual machine executing in a physical processor of the server.

As used herein, the terms "component" and "system" are intended to encompass hardware, software, or a combination of hardware and software. Thus, for example, a system or component may be a process, a process executing on a processor, or a processor. Additionally, a component or system may be localized on a single device or distributed across several devices.

Also, as used herein a processor corresponds to any electronic device that is configured via hardware circuits, software, and/or firmware to process data. For example, processors described herein may correspond to one or more (or a combination) of a microprocessor, CPU, FPGA, ASIC, or any other integrated circuit (IC) or other type of circuit that is capable of processing data in a data processing system, which may have the form of a controller board, computer, server, mobile phone, and/or any other type of electronic device.

Those skilled in the art will recognize that, for simplicity and clarity, the full structure and operation of all data processing systems suitable for use with the present disclosure is not being depicted or described herein. Instead, only so much of a data processing system as is unique to the present disclosure or necessary for an understanding of the present disclosure is depicted and described. The remainder of the construction and operation of data processing system 300 may conform to any of the various current implementations and practices known in the art.

Also, it should be understood that the words or phrases used herein should be construed broadly, unless expressly limited in some examples. For example, the terms "include" and "comprise," as well as derivatives thereof, mean inclusion without limitation. The singular forms "a", "an" and "the" are intended to include the plural forms as well, unless the context clearly indicates otherwise. Further, the term "and/or" as used herein refers to and encompasses any and all possible combinations of one or more of the associated listed items. The term "or" is inclusive, meaning and/or, unless the context clearly indicates otherwise. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Also, although the terms "first", "second", "third" and so forth may be used herein to describe various elements, functions, or acts, these elements, functions, or acts should not be limited by these terms. Rather these numeral adjectives are used to distinguish different elements, functions or acts from each other. For example, a first element, function, or act could be termed a second element, function, or act, and, similarly, a second element, function, or act could be termed a first element, function, or act, without departing from the scope of the present disclosure.

In addition, phrases such as "processor is configured to" carry out one or more functions or processes, may mean the processor is operatively configured to or operably configured to carry out the functions or processes via software, firmware, and/or wired circuits. For example, a processor that is configured to carry out a function/process may correspond to a processor that is executing the software/firmware, which is programmed to cause the processor to carry out the function/process and/or may correspond to a processor that has the software/firmware in a memory or storage device that is available to be executed by the processor to carry out the function/process. It should also be noted that a processor that is "configured to" carry out one or more functions or processes, may also correspond to a processor circuit particularly fabricated or "wired" to carry out the functions or processes (e.g., an ASIC or FPGA design). Further the phrase "at least one" before an element (e.g., a processor) that is configured to carry out more than one function may correspond to one or more elements (e.g., processors) that each carry out the functions and may also correspond to two or more of the elements (e.g., processors) that respectively carry out different ones of the one or more different functions.

In addition, the term "adjacent to" may mean: that an element is relatively near to but not in contact with a further element; or that the element is in contact with the further portion, unless the context clearly indicates otherwise.

Although an exemplary embodiment of the present disclosure has been described in detail, those skilled in the art will understand that various changes, substitutions, variations, and improvements disclosed herein may be made without departing from the spirit and scope of the disclosure in its broadest form.

None of the description in the present application should be read as implying that any particular element, step, act, or function is an essential element, which must be included in the claim scope: the scope of patented subject matter is defined only by the allowed claims. Moreover, none of these claims are intended to invoke a means plus function claim construction unless the exact words "means for" are followed by a participle.

What is claimed is:

1. A system for providing functional safety monitoring of relay contacts comprising:

a contactless sensor circuit that includes:

an output signal antenna positioned in the contactless sensor circuit to extend between at least two contacts of a relay; and first and second input signal antennas positioned in the contactless sensor circuit respectively adjacent the at least two contacts of the relay, such that the output signal antenna and the at least two contacts of the relay are positioned between the first and second input signal antennas; and a processor configured to cause the output signal antenna to output a wireless signal capable of being received by the first and second input signal antennas while the processor monitors wireless signals received by the first and second input signals antennas, wherein the processor is configured to determine that the relay has a fault based on the wireless signals received by the first and second input signal antennas, and responsive thereto output at least one communication indicative of a fault with the relay being detected.

2. The system according to claim 1, further comprising the relay including the at least two contacts, wherein the output signal antenna is positioned parallel to and between the at least two contacts and the first and second input signal antennas are positioned parallel to and adjacent to the at least two contacts.

3. The system according to claim 1, further comprising a printed circuit board with the relay mounted to the board.

4. The system according to claim 1, further comprising a relay socket configured to receive therein terminals of the relay including the at least two contacts.

5. The system according to claim 4, wherein the output signal antenna and the first and second input signal antennas are mounted with the relay socket.

6. The system according to claim 3, wherein the output signal antenna and the first and second input signal antennas are mounted to the printed circuit board.

7. The system according to claim 1, wherein the contactless sensor circuit includes:

a signal generator in electrical communication with the output signal antenna; and at least two processing circuits in electrical communication with the first and second input signal antennas, wherein the processor is configured to cause the signal generator to cause the output signal antenna to output the wireless signal, wherein the processing circuits are configured to at least one of amplify or filter the wireless signals detected by the first and second input signal antennas and provide information therefrom to the processor, wherein the processor is configured to output the at least one communication indicative of the fault with the relay being detected to at least one fault handling circuit based on the information provided by the at least two processing circuits, wherein the fault handling circuit is configured to removing electrical power from the relay; output a visual and/or audible alarm signal; or a combination thereof.

8. A method for providing functional safety monitoring of relay contacts comprising:

through operation of a processor:

causing an output signal antenna to output a wireless signal capable of being received by first and second input signal antennas included in a contactless sensor circuit in which:

the output signal antenna extends between at least two contacts of a relay; and the first and second input signal antennas are positioned respectively adjacent the at least two contacts of the relay, such that the output signal antenna and the at least two contacts of the relay are positioned between the first and second input signal antennas;

monitoring wireless signals received by the first and second input signal antennas;

determining that the relay has a fault based on the wireless signals received by the first and second input signal antennas; and responsive to determining that the relay has the fault, outputting at least one communication indicative of a fault with the relay being detected.

9. The method according to claim 8, wherein during monitoring wireless signals, the relay is mounted to a printed circuit board such that the output signal antenna is positioned parallel to and between the at least two contacts and the first and second input signal antennas are positioned parallel to and adjacent to the at least two contacts.

10. The method according to claim 8, wherein during monitoring wireless signals, the relay includes at least two terminals that include the at least two contacts and the terminals are inserted into a relay socket.

11. The method according to claim 8, wherein during monitoring wireless signals, the output signal antenna and the first and second input signal antennas are mounted within the relay socket.

12. The method according to claim 8, wherein during monitoring wireless signals, the output signal antenna and the first and second input signal antennas are mounted to the printed circuit board.

13. The method according to claim 8, wherein the contactless sensor circuit includes:

a signal generator in electrical communication with the output signal antenna; and at least two processing circuits in electrical communication with the first and second input signal antennas, further comprising:

through operation of the processor, causing the signal generator to cause the output signal antenna to output the wireless signal, through operation of the at least two processing circuits, at least one of amplifying or filtering the wireless signals detected by the first and second input signal antennas and providing information therefrom to the processor, wherein the at least one communication indicative of a fault with the relay being detected is outputted to at least one fault handling circuit based on the information provided by the at least two processing circuits.

14. The method according to claim 13, further comprising:

through operation of the fault handling circuit:

removing electrical power from the relay;

outputting a visual and/or audible alarm signal; or a combination thereof.

15. A non-transitory computer readable medium encoded with executable instructions that when executed, cause the processor to carry out the method according to claim 8.

* * * * *